United States Patent [19]

Lammersen

[11] 4,009,880

[45] Mar. 1, 1977

[54] RECREATIONAL DEVICE

[75] Inventor: William B. Lammersen, Littleton, Colo.

[73] Assignee: Patterns to Play By, Inc., Golden, Colo.

[22] Filed: Nov. 17, 1975

[21] Appl. No.: 632,503

[52] U.S. Cl. ..... 273/1 R

[51] Int. Cl.[2] ..... A63F 9/00

[58] Field of Search ..... 273/1 R, 1 A; 35/29 C

[56] References Cited

UNITED STATES PATENTS

| | | | |
|---|---|---|---|
| 1,815,443 | 7/1931 | Mitchell | 35/29 C |
| 3,454,279 | 7/1969 | Foley | 273/134 AD |
| 3,484,106 | 12/1969 | Foley | 273/1 R |
| 3,879,034 | 4/1975 | Petrusek | 273/1 R |

*Primary Examiner*—William H. Grieb
*Attorney, Agent, or Firm*—John E. Reilly

[57] ABSTRACT

Outlines or patterns of human forms are represented in predetermined, contiguous relation to one another on a flat horizontal surface or sheet of material, each outline being distinguishable one from another in such a way as to permit one or more persons to place themselves in different positions represented by the outlines or to advance from one outline to another.

4 Claims, 1 Drawing Figure

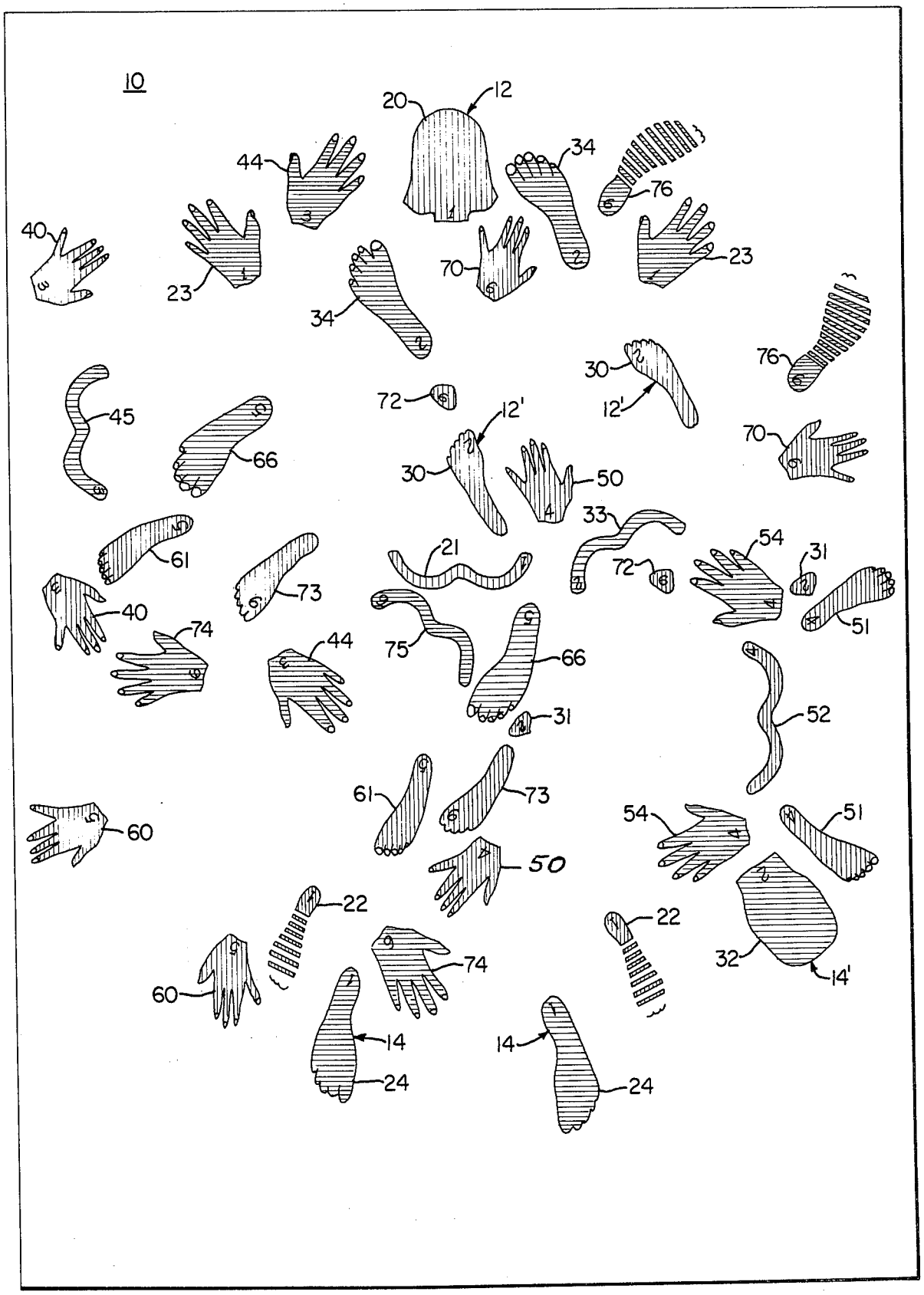
10
12
20
44
34
76
40
23
70
23
34
76
30
12'
45
72
12'
70
66
30
50
33
61
21
54
31
72
73
40
51
74
44
75
66
52
31
61
73
60
54
51
50
22
22
32
14'
60
74
14
14
24
24

RECREATIONAL DEVICE

This invention relates to recreational devices and more particularly to an article containing representations correlated with numerical and color designations to differentiate between each outline.

BACKGROUND OF THE INVENTION

Various recreational devices or games have been devised involving placement of articles or pieces in particular spaces as well as advancement of the articles from space to space in some predetermined order. Also it has been known to devise games in which spaces are provided to be occupied in some manner by a person who then must advance along a predetermined path or combination of spaces. However, to the best of our knowledge nothing has been devised in the past or made available which would permit or require that two different persons simultaneously occupy given spaces in predetermined relation to one another as well as to advance or assume different positions on those spaces in relation to one another whether for example as a game, instructional aid or other form of recreation.

SUMMARY OF THE INVENTION

It is therefore an object of the present invention to provide for a novel and improved pattern or arrangement of representations or outlines of human forms on a surface.

It is another object of the present invention to provide for predetermined outline representation of different portions, or extremities, of human forms on a surface or sheet of material, the outlines being distinguishable one from another and being so arranged as to permit two or more persons to simultaneously assume different positions on the surface as represented by the outline.

It is a further object of the present invention to provide outlines of extremities of human forms on a common surface or sheet of material, each outline representing a different position from the others and being represented by a different color or numerical designation, or a combination of both.

In accordance with the present invention, a flat surface or sheet of material contains outlines of at least a pair of human forms represented on the surface, the outline of each human form having a different distinctive representation than each other outline so as to be readily distinguishable from the others, each outline preferably defined by different specific portions of the human body, such as, the head, hands or arms, buttocks, feet, or knees. Further, each outline is arranged in a different predetermined pattern on the surface so as to permit two or more persons to simultaneously occupy the outlines on the sheet and to assume various different positions on the sheet. Where the outline is comprised of a combination of different portions or extremities of the human body, such portions or extremities as represented preferably bear combinations of a common color designation and common numerical designation so as to distinguish same from the other outlines.

BRIEF DESCRIPTION OF THE DRAWINGS

The above and other objects, advantages and features of the present invention will become more readily appreciated and understood from a consideration of the following description of a preferred form thereof when taken together with the accompanying plan view of a preferred form of the present invention.

DETAILED DESCRIPTION OF THE PREFERRED EMBODIMENT

Referring in detail to the drawing, there is shown by way of illustrative example a flat horizontal surface portion 10 which may for example take the form of a linen sheet or cloth having imprinted on one side thereof a series of outlines or representations 12 and 14 of two human forms arranged in different predetermined patterns on the sheet.

In the form shown, only certain portions of the human body are represented, such as, the head, hands, arms, feet, knees or buttocks and those portions representing each human form in each given position are given the same numerals in combination with a distinctive color designation. For instance, the first outline represented by a combination of the color "yellow" and the numerical designation 1 includes a head 20, buttocks 21 and feet 22. Another outline 14 is colored "brown" and comprises representations of the hands 23 and feet 24 denoting the placement of the hands and feet, soles up, of the person represented by the second outline and also bearing the numerical designation 1. Thus, one person would occupy the representation or position 12 as described at the same time that another person occupies the representation 14.

A second position 12' to be occupied by the person occupying the first position 12, bearing the yellow color designation, is represented by feet 30, soles up, and knees 31 and bearing the same color designation as the first representation, i.e. the color yellow, and the numerical designation 2. Similarly, another representation 14' which is given a blue color designation and represented by the head 32, buttocks 33 and feet 34, all bearing the numerical designation 2 denote a second position to be occupied by the person occupying the first representation 14 and having the same color designation.

Correspondingly, and in a similar fashion, it will be seen that other positions are designated for the person occupying the yellow color designation; namely, those portions of the human body designated in yellow bearing the numeral 3 and identified by hands 40; a fourth position represented by hands 50, feet 51 and buttocks 52 and all bearing the numeral 4, a fifth position represented by the hands 60 and feet 61 bearing the numerical designation 5, and a sixth position represented by hands 70, knees 72 and feet 73, all bearing the numerical designation 6.

Other positions are similarly illustrated for the blue-color designation, the third position 3 being represented by the hands 44 and buttocks 45; a fourth position represented by the hands 54 bearing the numerical designation 4; a fifth position bearing the numerical designation 5 being represented only by the feet 66; and a sixth position represented by the numeral 6 consisting of hands 74, buttocks 75 and feet 76.

Generally, it will be noted that each position bearing a common numerical designation for each respective color designation represents the space that two persons may simultaneously occupy on the sheet. Moreover, whether the position or attitude of the body is to be face-up or face-down may also be suitably represented for example by different designations for the hands and feet such as illustrated by comparison of the feet 22 illustrating a face-up position and the feet 24 illustrating a face-down position. Still further, the outline or extremities of each human form imprinted on the sheet is a life-like representation with the spacing between extremities in each given position indicating the relative disposition between different parts of the body in that position so that in certain cases the body may be either stretched out, kneeling or standing. Of course the positions shown are merely illustrative of different positions which may be represented on the surface and which each person must occupy according to the numerical or color designation of the outline represented. Thus the position to be assumed may suitably serve as instructional aids for different intercourse positions between a man and woman, exercising, yoga or other recreational purpose. For example, when employed as a game, each person may be required to advance from one position to another in succession either alone or in combination with a partner in the least possible time.

It is therefore to be understood from the foregoing that various modifications and changes may be made and be apparent to those skilled in the art without departing from the spirit and scope of the present invention as defined by the appended claims and reasonable equivalents thereof.

What is claimed is:

1. In combination, an amusement device comprising:

a substantially flat horizontal surface portion, outlines of at least a pair of human forms represented on the surface portion, the outline of each human form being defined by representations of extremities of the human body with distinctive patterns to represent face-up and face-down positions of the human form, and each having a different distinctive representation than each other outline so as to be readily distinguishable therefrom, said outlines being arranged in different predetermined patterns on said sheet of material whereby to permit two or more persons to simultaneously occupy the outlines on said sheet and to assume different positions on said surface portion.

2. The combination according to claim 1, there being a plurality of outlines on said surface portion, each outline being coded with a distinctive color common to the other outlines intended to be occupied by the same person to distinguish from the outlines intended to be occupied by another person, and said outlines being grouped in sets, each set consisting of no more than one outline of each color code, and the extremities representing the outline of each human body in a set bearing a common number with all other extremities in the set and differing from the numbers associated with the extremities for other sets of human forms represented.

3. In combination, a recreational device comprising:

a sheet of material, outlines of a plurality of life-sized human forms comprised of representations of the extremities of the human body imprinted on said sheet of material, the outline of each human form having a different distinctive color combination than other outlines so as to be readily distinguishable therefrom, said outlines being arranged in different predetermined pattern sets on said sheet of material whereby to indicate the physical position for two or more persons to simultaneously occupy the outlines on said sheet and to assume different relative positions to one another on said sheet, and a number combination wherein the extremities representing the outline of each human body within a pattern set bear a common number differing from the number associated with the group of extremities for other human forms represented in other pattern sets.

4. The combination according to claim 3 in which the extremities representing each outline comprise different portions of the human body selected from the group consisting of the head, hands, feet, buttocks and knees, said outlines being of distinctive patterns to indicate face-up and face-down positions for the persons to occupy said human forms on said sheet of material.

* * * * *